US006617516B1

(12) United States Patent
Reynolds et al.

(10) Patent No.: US 6,617,516 B1
(45) Date of Patent: Sep. 9, 2003

(54) LEAD WIRE FOR OXYGEN SENSOR

(75) Inventors: Kim A. Reynolds, Berwyn, PA (US); David J. Panish, Norristown, PA (US)

(73) Assignee: Markel Corporation, Norristown, PA (US)

( * ) Notice: Subject to any disclaimer, the term of this patent is extended or adjusted under 35 U.S.C. 154(b) by 0 days.

(21) Appl. No.: 10/217,130

(22) Filed: Aug. 12, 2002

(51) Int. Cl.[7] ..... H01B 5/10
(52) U.S. Cl. ..... 174/128.1
(58) Field of Search ..... 174/128.1, 128.2, 174/69; 204/424, 427, 428; 73/23.31, 23.32

(56) References Cited

U.S. PATENT DOCUMENTS 1,904,116 A 4/1933 Baum
2,098,163 A 11/1937 Reed ..... 117/58
4,349,694 A 9/1982 Vives ..... 174/128 R
4,689,444 A 8/1987 Burgess ..... 174/128 R
5,290,421 A 3/1994 Reynolds et al. ..... 204/424
5,696,352 A 12/1997 Kourimsky ..... 174/126.3
5,969,229 A 10/1999 Hori et al. ..... 73/23.31
6,448,502 B2 9/2002 Reynolds et al. ..... 174/128.1

*Primary Examiner*—Chau N. Nguyen
(74) *Attorney, Agent, or Firm*—Synnestvedt & Lechner LLP

(57) ABSTRACT

A lead wire for use with an oxygen sensor is disclosed. The wire is formed of a center strand having high tensile strength surrounded by a plurality of first strands having high electrical conductance and a plurality of second strands having high tensile strength. The first and second strands are surrounded by a plurality of third strands having high electrical conductance and arranged in groups, and a plurality of fourth strands having high tensile strength, each fourth strand being positioned between two groups of third strands. The second and fourth strands are spaced at equal separation angles around the center strand.

25 Claims, 2 Drawing Sheets

LEAD WIRE FOR OXYGEN SENSOR

FIELD OF THE INVENTION

This invention relates to lead wires for use with oxygen sensors and especially to lead wires formed from multiple strands made of different materials.

BACKGROUND AND OBJECTS OF THE INVENTION

Internal combustion engines and particularly automotive-type internal combustion engines produce exhaust gases which include carbon monoxide, unburned or partially burned hydrocarbons and nitrogen oxides. These materials are undesirable byproducts of the combustion process, and their presence in the exhaust gases can be substantially reduced by proper control of combustion conditions. One condition which is important in establishing efficient combustion and hence reduced levels of pollutants in the exhaust gas is the amount of air provided to the combustion process. The amount of air introduced into the combustion chamber is frequently controlled by systems which first require determining the oxygen content in the exhaust gas. This information is then utilized to control the respective amounts of fuel and air being supplied to the engine so that the exhaust gases will have the desired combustion. Thus, electrochemical sensors have heretofore frequently been used as part of electrical systems in automobiles for measuring and controlling the composition of exhaust gases. One such sensor is disclosed in U.S. Pat. No. 5,290,421 to Reynolds et al, which is hereby incorporated by reference.

Such sensors typically utilize a solid electrolyte to determine the oxygen concentration in the exhaust gases. The electrolyte typically comprises an oxygen-ion-conductive tube or cone having an electrode on the outer and inner surfaces thereof. The outer surface of the sensor is exposed to the exhaust gases, and the interior of the sensor is provided with a reference source of oxygen, such as ambient air. In operation, the differential in oxygen concentration between the exhaust gases and the reference source causes conduction of oxygen ions through the ion-conductive body, resulting in an electrical current which is dependent upon the relative content of oxygen in the exhaust gas and the reference source.

In order to fully activate the solid electrolyte of such sensors and to obtain an appreciable output voltage for measuring oxygen concentration, the sensor element must be heated to an elevated temperature. It has frequently been common practice to rely upon the heat of the exhaust gases passing over the outer electrode to cause the necessary increase in the temperature of the sensor element. However, this procedure has a drawback, namely, such arrangements result in a sensor that is essentially inoperative or only marginally operative, during the warm-up period of the internal combustion engine; yet, it is during this warm-up period that the concentration of pollutants in the exhaust gases is the highest. In order to overcome this disadvantage, oxygen sensors are provided with an electrical heating element for rapidly increasing the temperature of the sensor.

Thus, oxygen sensors require electrically-conductive pathways to carry: (1) the electrical current which is proportional to the oxygen concentration in the exhaust gases in a feedback loop to the control system which determines the fuel/air ratio supplied to the engine; and (2) the electrical current which powers the heating element allowing the oxygen sensor to operate effectively during the transient engine warm-up period.

The conductive pathways are provided by oxygen sensor lead wires. The lead wires are subject to extremely harsh environmental conditions. They must run between the exhaust system of an automobile and the engine compartment and are, thus, subject to extremes of heat, cold, vibration, tensile and compression forces and abuse from roadway hazards, yet they must maintain electrical continuity, ideally for the operational life of the vehicle, to ensure that the signals from the oxygen sensor are communicated to the control system with the utmost fidelity and that the heating element receives the necessary power to maintain the sensor at the required operating temperature during the critical warm-up period of engine operation.

To meet the harsh environmental and performance demands, lead wires for oxygen sensors have developed into multi-strand wires having various strands of different material types redundant to provide the flexibility, robustness, strength and long fatigue life required for effective operation. The conventional wisdom teaches that these characteristics can be best achieved by increasing the number of strands while decreasing the gage of each strand. For example, lead wires having 37 strands are not uncommon, and lead wires having over 100 strands are also in production.

While multi-strand lead wires developed according to the conventional theories do exhibit the characteristics necessary for effective use with oxygen sensors, such lead wires suffer from a tremendous cost disadvantage in that they are complicated, expensive and difficult to produce. Production is expensive because with increasing numbers of strands, it becomes more difficult to lay them together in one pass through the wire laying machines, thus, requiring multiple passes which increase the production time required. Wires having more and finer strands are also more prone to the phenomenon of "birdcaging" a failure mode which occurs during production when the wire is subjected to compression forces and the strands splay outwardly to form a cage-like expansion of a section of the wire. Birdcaging can result in a "high strand", an individual strand which extends outwardly from the multi-strand wire further than the other strands comprising the wire. The projecting strand often becomes caught on a piece of machinery or a die during production, and the strand is stripped from the wire as the wire passes through the machine, eventually forming a tangled mass of strand and forcing a shutdown of the production line and scrapping of a significant length of the wire produced. The increased propensity for birdcaging also limits the speed at which the wire laying machinery can be operated, in order to keep the forces placed on the wire low and avoid birdcaging or other failures.

Another disadvantage of traditional multi-strand lead wires is that such wires tend to yield and take a permanent set when packaged on a spool or drum. The wire must later be straightened so that it can be attached to the oxygen sensor or other terminals, usually by automated crimping machines. The straightening process adds a step which increases the cost and decreases the rate of production. The straightening process also subjects the wire to potential damage in that the adhesion between the insulating layer and the wire can be disrupted, allowing significant lengths of the insulation to separate from the wire, rendering the wire worthless and, thus, lowering production efficiency.

Yet another disadvantage of traditional multi-strand lead wires is their "notch sensitivity" or lack of toughness in resisting physical damage without developing indentations, cracks or other flaws, usually in the outermost strands comprising the wire. Notch sensitivity is important because any flaws in the wire strands serve as stress risers and crack initiation points from which cracks propagate and cause premature fatigue failure of the strands when the wire is subjected to reverse bending stresses as experienced, for example, in a high vibration environment. As individual strands fail in fatigue, the stress is shared by an ever decreasing number of remaining strands, thus, increasing the stress on the strands and accelerating the fatigue failure of the wire. Multi-strand wires having relatively soft nickel plated copper strands in the outermost layer are particularly notch sensitive. Damage to the wire can hardly be avoided, and can occur during the production process, during installation or in use. Crimping of the wires to form electrical connections can be especially damaging to the outer wire layer and can shorten the fatigue life of the wire dramatically.

Clearly, there is a need for an improved oxygen sensor lead wire which can meet the harsh environmental conditions and performance demands but which is simple and inexpensive to produce.

SUMMARY AND OBJECTS OF THE INVENTION

The invention concerns a lead wire for use with an oxygen sensor. In a preferred embodiment, the lead wire according to the invention comprises an elongate center strand having a relatively high tensile strength. Hard stainless steel is a preferred material for the center strand. A plurality of elongate first strands, each having a relatively high electrical conductance, are arranged circumferentially in spaced relation around the center strand. The first strands preferably comprise a copper alloy. A plurality of elongate second strands, each having a relatively high tensile strength, are arranged circumferentially in spaced relation around the center strand and between the first strands in an alternating pattern, preferably at equal separation angles circumferentially around the center strand. Hard stainless steel is again preferred. A plurality of elongate third strands, each having a relatively high electrical conductance, are arranged circumferentially in a plurality of groups around the first and second strands. Each of the groups comprises a predetermined number of the third strands, preferably three. A plurality of elongate fourth strands, each having a relatively high tensile strength, are arranged circumferentially around the first and second strands. Each of the fourth strands are positioned between two of the groups of the third strands. Preferably, the fourth strands are spaced circumferentially around the center strand at equal separation angles. Quarter-hard stainless steel is the preferred material for the fourth strands. Half-hard stainless steel may be any alternate material.

It is an object of the invention to provide an oxygen sensor lead wire which has a high tensile strength and fatigue life.

It is another object of the invention to provide an oxygen sensor lead wire comprised of a minimum of strands.

It is yet another object of the invention to provide a lead wire with a relatively low notch sensitivity which can resist physical damage and avoid flaws which result in stress risers which cause premature fatigue failure of the wire.

It is again another object of the invention to provide an oxygen sensor lead wire which can be formed in one pass through automated wire laying machinery.

It is yet another object of the invention to provide a lead wire which is less prone to birdcaging failure.

It is still another object of the invention to provide a lead wire which is less prone to the high strand condition and its associated failure.

It is yet another object of the invention to provide a lead wire which allow the wire laying machinery to run at higher speeds.

It is also another object of the invention to provide a lead wire which is less prone to take on a permanent set when wound around a spool or drum.

These and other objects of the invention will become apparent from a consideration of the following drawings and detailed description of a preferred embodiment of the invention.

DETAILED DESCRIPTION OF THE PREFERRED EMBODIMENTS

Figure 1:
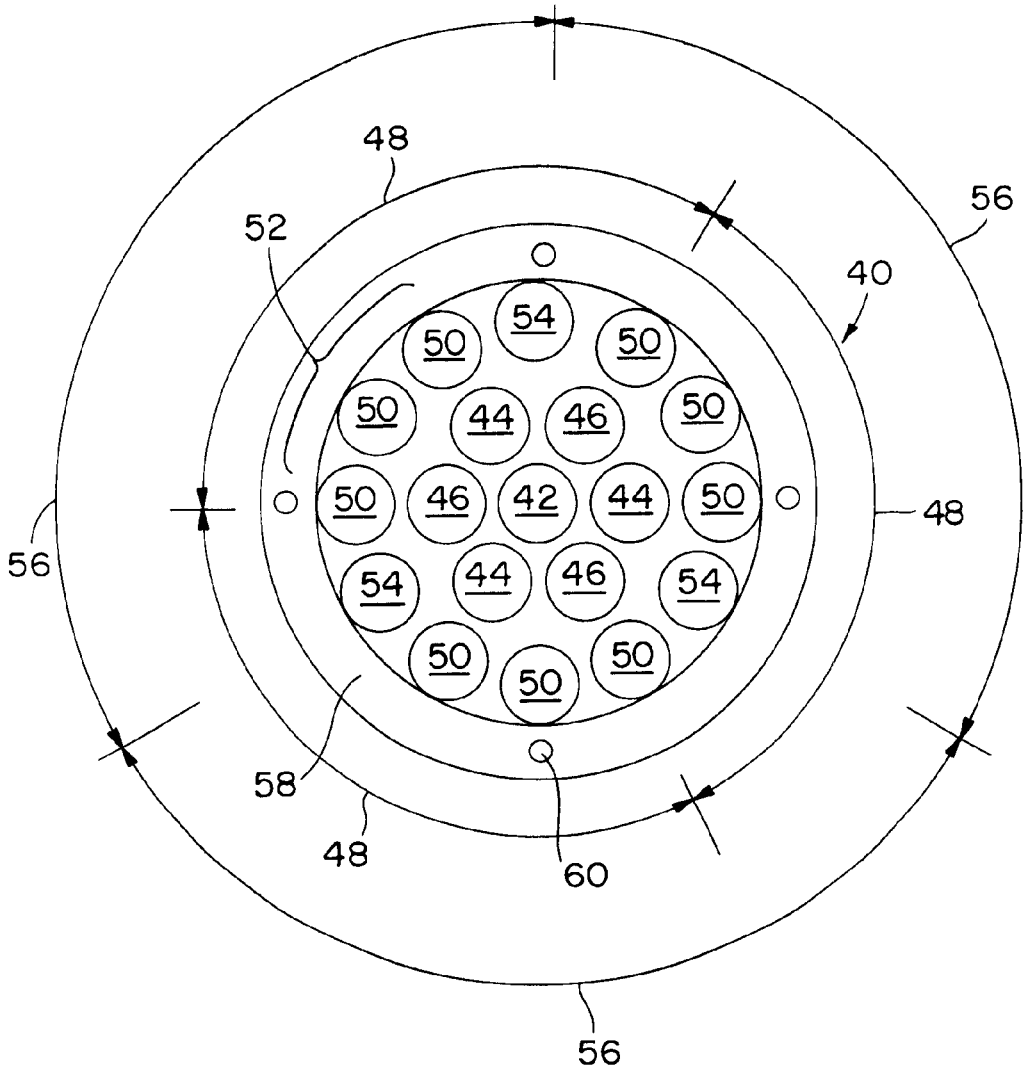
FIG. 1 shows a cross-sectional view of a lead wire according to the invention.

FIG. 1 shows a cross-sectional view of a lead wire 40 according to the invention for use with an oxygen sensor. Lead wire 40 comprises an elongate center strand 42 made of a material having a relatively high tensile strength. Hard stainless steel is preferred for center strand 42 because it combines high tensile strength and toughness with adequate flexibility, enabling the wire 40 to endure harsh environments yet still remain flexible so as to follow a curving path along the automobile structure.

Electrically conductive elongate strands 44 are arranged circumferentially around the center wire 42 in spaced relation to one another. Strands 44 are made of a material having relatively high electrical conductance. Nickel plated copper is the preferred material due to copper's excellent conductance and low cost.

High strength strands 46 are arranged circumferentially around the center strand 42 in spaced relation to one another. High strength strands 46 are preferably also hard stainless steel and are positioned in an alternating pattern between the conductive strands 44. It is preferred to position the high strength strands at substantially equal separation angles 48 around the center strand in order to create a wire 40 having a balanced design. A balanced design will ensure that tensile loads are distributed substantially equally to all of the strands thereby providing for increased fatigue life as compared with unbalanced designs which tend to load the strands unequally, often resulting in progressive failure, strand-by-strand of the highest loaded strands, and a concomitant decreased fatigue life expectancy.

Additional electrically conductive strands 50 are arranged circumferentially around the high strength strands 46 and the electrically conductive strands 44. The preferred material for strands 50 is again nickel plated copper. Together with conductive strands 44, conductive strands 50 ensure adequate conductivity to the wire 40 so that signals and power may be carried without significant loss due to resistance of the wire 40.

Conductive strands 50 are preferably arranged in groups of strands 52, each group consisting of a predetermined number of conductive strands. The groups of strands 52 are separated by additional high strength strands 54, each arranged between two groups 52 and circumferentially around the conductive strands 44 and the high strength strands 46. The preferred material for the high strength strands 54 is quarter-hard stainless steel. Half-hard stainless steel may also be used. Although having a lower tensile strength and fatigue life than hard stainless steel, the quarter-hard stainless steel has greater flexibility. Use of a more flexible material in the outer strands 54 of the wire 40 in combination with a stiffer material (e.g., hard stainless steel) for the inner strands (42, 46) provides a wire with excellent fatigue life and strength which is nevertheless flexible and, thus, able to be handled by high-speed wire laying machinery with less risk of high strands or birdcaging to disrupt the production process. The wire 40 constructed is also more easily spooled and unspooled, less likely to take a permanent set upon being spooled and easier for a technician to install in a particular application. It is advantageous to position the more flexible strands as the outermost strands of the wire 40 because these strands will have the greatest area moment of inertia and thus exert a proportionally greater influence on the overall stiffness of the wire 40. If the outer strands are too stiff, the overall stiffness of the wire 40 will be too great, and the disadvantages caused thereby in production and handling characteristics of the wire will outweigh any advantages realized in fatigue life or tensile strength. However, if stiffness is not a concern or if it is desired, then it is advantageous to place strands of higher stiffness, such as hard stainless steel, in the outermost regions of the wire 40. Again, it is preferred to position the high strength strands 54 at substantially equal separation angles 56 around center strand 42 to maintain a balanced design for equal distribution of tensile loads.

An elongated tubular sheath 58, preferably made of PTFE, surrounds the outermost strands 50 and 54 to form a protective and insulating cover for the lead wire 40. Sheath 58 may have a plurality of passages 60 extending lengthwise through the sheath to allow the passage of gases through the sheath to the oxygen sensor with which lead wire 40 is operatively associated.

Numerous variations of the aforementioned embodiment are possible without departing from the invention as contemplated. For example, center strand 42 can be made of either soft stainless steel or hard stainless steel, of alloys such as AISI 304 or 302. Outermost strands 54 can also be formed of either soft or hard stainless steel or a combination of both materials.

The preferred embodiment, as well as any alternate embodiments, are preferably formed with the inner strands and outer strands having the same length and direction of lay, the specific lay length being between about 0.4 to 0.6 inches and preferably about 0.493 inches. Other lay configurations are also possible, however. For example, the inner strands 44 and 46 could have a larger or smaller specific lay length than the outer strands 50 and 54 and/or the direction of the lay could be different with the inner layer having an opposite twist from the outer layer.

Manufacturing Process

The preferred machinery for the manufacture of multi-strand lead wire according to the invention is a "tubular"-type wire strander, so named because it features a rotating tube which is used to impart twist to the wire as described below. The strander has at least 19 separate positions or "bays", each one of which accommodates one spool which feeds one of the 19 strands comprising the wire to the machine. In operation, the individual strands come off the spools and are guided lengthwise along the surface of the rotating tube through guides fixed to the tube. The strands are then directed through fixed positioning guides at the downstream end of the tube into one or more forming dies. The strands are brought together by the forming die or dies, thereby forming the multi-stranded lead wire. Twist is imparted to the strands as they are brought together by the forming die or dies by continuous rotation of the tube about its longitudinal axis as the strands pass along the tube. Capstans, located downstream of the forming die or dies, pull the strands through the forming die or dies. The rate at which the capstans pull the strands, in conjunction with the rate at which the tube is rotated, establishes the lay length of the wire. A take-up mechanism arranged downstream of the capstans has a take-up reel which is rotated at the appropriate rate. to pull the wire onto reel as the wire is made, maintaining constant tension on the wire at all times.

The position of reels of strand in the stranding machine must allow for proper alignment of the strands as they are fed to the machine in order to ensure the proper relative placement of each strand in the wire. It is important that each strand be correctly located in the proper positioning guide in order to establish and maintain correct strand positioning throughout the manufacturing process. The inner strands 42, 44 and 46 and the outer strands 50 and 54 are directed through stranding dies located at the point where the strands converge. The stranding dies serve to help maintain correct strand position, establish uniform surface condition of the wire and control the overall lead wire diameter.

Specific Example of the Preferred Embodiment

As shown in FIG. 1, a center strand 42 of hard stainless steel is circumferentially surrounded by 3 strands 44 of nickel plated copper. The nickel layer is plated over a copper alloy between about 40 and 100 micro-inches in thickness and preferably about 80 micro-inches thick. Three high strength strands 46 of hard stainless steel also surround the center strand 42 and are arranged in an alternating pattern between each of the three conductive strands 44. The high strength strands 46 are equally spaced circumferentially at separation angles of about 120° to provide a balanced design.

The outer 12 strands are arranged in a repeating pattern wherein three groups 52, each comprised of three nickel plated copper strands 50, are separated from one another by three quarter-hard stainless steel strands 54, one strand 54 being positioned between each group 52 of three strands 50. The high strength strands 54 are equally spaced circumferentially at separation angles of about 120 degrees to provide a balanced design. A tubular insulating sheath 58 surrounds the strands. All strands comprising the example are number 32 AWG producing a lead wire 40 of number 20 AWG.

Physical Property Advantages of the Example

By positioning stainless steel strands such as 42, 46 and 54 in the center and outermost regions of the above-described example lead wire, the tensile strength and fatigue life of the wire is superior to many commonly used prior art lead wires. A fatigue life of over 4,000 cycles and an increase in tensile strength on the order of 20% over prior art lead wires has been achieved with the example design.

Figure 2:
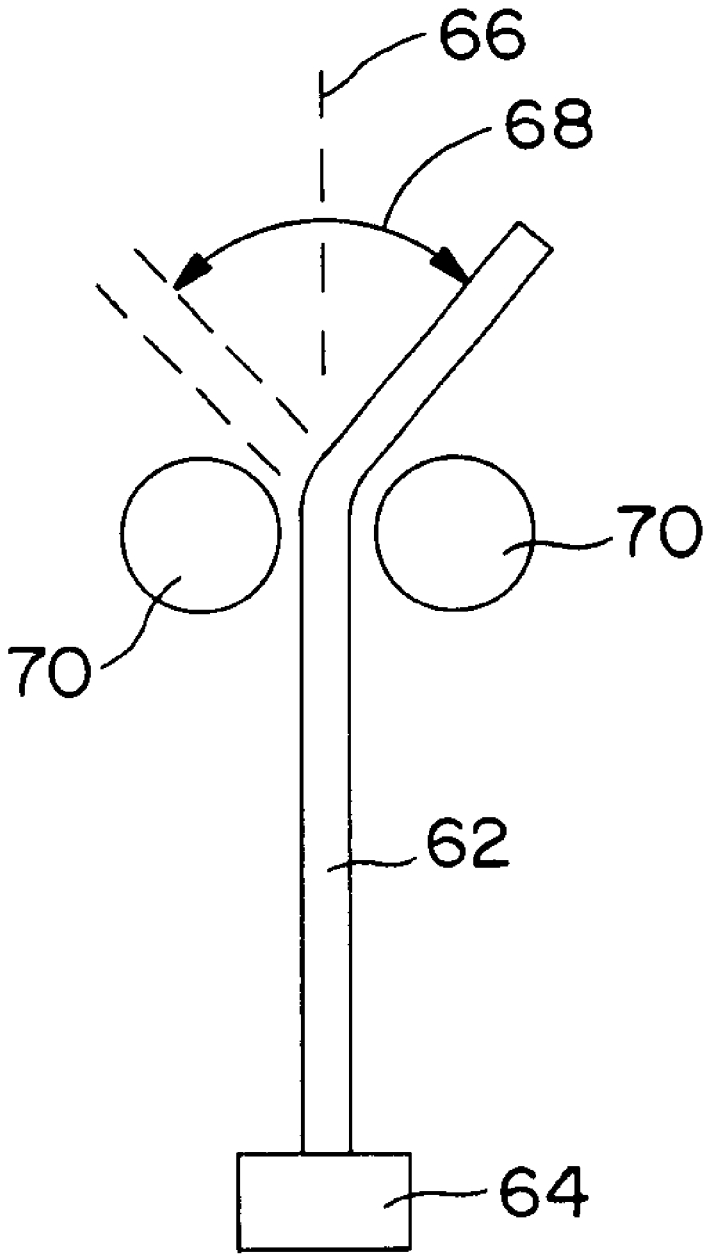
FIG. 2 shows a schematic diagram of a bending test procedure.

The lead wires according to the example described above are subjected to a tensile test (ASTM Standard D638), which determines the ultimate breaking strength, and a fatigue test. In the fatigue test, illustrated schematically in FIG. 2, a standard length of a lead wire 62 is stripped of insulation and loaded with a weight 64 of 500g in tension and repeatedly bent through an angle of 90° (+/−45) from a vertical reference 66 as indicated by arrow 68. Lead wire 62 is bent over adjacent mandrels 70 having a diameter of 10 mm at a frequency of 20 cycles per minute. Mandrels 70 are spaced apart 2.2 mm for AWG 18 wire, and 2.0 mm for AWG 20 wire. The fatigue life is determined by the number of cycles required to break the wire.

Breaking strength is an important characteristic of the lead wire because it is a direct measure of the robustness and durability of the wire. Wires having higher breaking strengths are desired because they will better endure the forces and abuse experienced by the wire during production and in use as described below.

The fatigue life of the example wire is significantly improved over many commonly used prior art lead wires. This is a surprising result which goes completely against the conventional wisdom, which teaches that an increase in fatigue life can only be obtained by increasing the number of the strands and decreasing the gage of each strand.

One possible explanation for the superior fatigue life of the example lead wire over the prior art wires is that the strands having relatively high stiffness and fatigue strength, i.e., the stainless steel strands 54, are positioned outermost from the neutral axis where the stresses due to bending are greatest. Because the stainless steel strands are inherently stiffer than the copper strands, they see proportionally more of the bending stresses, and because stainless steel has a greater fatigue strength, it is also better able to survive multiple cycles of reverse bending stress which is damaging and leads to fatigue failure. Furthermore, arranging the high strength strands throughout the wire in a balanced pattern, with substantially equal separation angles, helps distribute the load to the strands more equally and thus prevents or at least inhibits progressive fatigue failure of individual, highly loaded strands.

The fatigue life of a lead wire is an important design parameter because lead wires are typically employed in high vibration environments such as in automotive applications where they are subjected to large numbers of reverse bending stress cycles causing the fatigue life to be the controlling factor determining the operational life of the oxygen sensor in many cases.

Manufacturing Advantages

Significant manufacturing advantages are also achieved by the example lead wires according to the invention. The invention has only 19 strands comprising the wire, and this number of strands can be easily manufactured with all of the strands being laid in one pass by existing machines. Wires with greater numbers of strands must often be made in multiple passes, thus, increasing the time and cost of production.

Positioning quarter-hard or half-hard stainless steel strands in the outermost regions of the wire 40 increases the breaking force and stiffens the wire according to the invention, allowing the machines to run at higher speeds with greater force on the wire. Because the wire is stiffer and under higher tension loads, it is also less susceptible to instability failures such as birdcaging. This allows the manufacturing machines to work at the higher speeds with less tendency for individual strand failure, breakage and stripping away due to the "high strand" problem described above, resulting in fewer production line interruptions, less scrap and higher efficiency of production. However, the outermost strands are not too stiff so that the wire 40 will still retain sufficient flexibility to feed properly through the wire strander without undue force or difficulty.

Because the wire according to the invention has a higher breaking strength it can be pulled through the sheathing process at higher forces and greater speeds, thus, increasing the rate of production.

Advantages During Use

The example lead wire according to the invention also provides significant advantages during use. The stainless steel in the outer layer acts as armor which provides a tough outer layer with low notch sensitivity. The stainless steel strands effectively resist nicks, cuts, dents, cracks and any other physical damage which might occur during manufacture, installation or in operation and would otherwise result in stress risers being formed on the strands. As explained above, stress risers serve as crack initiation points from which cracks propagate and lead to premature fatigue failure of the wire. Crimping operations can be especially damaging to the softer strands comprising traditional lead wires and can lead to rapid fatigue failure at or near the crimp. By positioning the tough stainless steel wires in the outer region, damage to the strands is less likely to occur and the softer nickel plated copper strands are protected against the crushing forces imposed by the crimping operation.

Positioning the inherently stiffer stainless steel strands in the outer layer also increases the section modulus of the wire and places strands in outer layer which have a higher yield stress than nickel plated copper. This combination of higher section modulus and higher yield strength in the outer layer reduces the propensity of the wire to take a curved permanent set when stored wrapped around a spool or drum. This is important during the crimping operation because the wire must be straight for the crimping machines to work efficiently and avoid misfeeds.

Many prior art lead wires of nickel plated copper have a relatively low yield stress and consequently take a significant permanent set when they are stored wound around a spool after manufacture and before use. The permanent set causes such wires to remain in a curved shape when they are unwound from the spool. The curved wires must be straightened prior to being fed to the crimping machines if wire misfeeds which disrupt the production line are to be avoided. However, the straightening process adds a step to the assembly procedure, increasing cost and slowing the procedure down and can damage the wire by breaking the adhesive bond between the wire strands and the insulating sheath. If the bond between the sheath and strands is broken, then when the wire is stripped to form the various electrical connections necessary for operation of the oxygen sensor the entire length of sheath may come off the wire, rendering it useless. The wires according to the invention tend not to take a curved permanent shape when wrapped around a spool, therefore, minimizing the force required to straighten the wire or entirely eliminating the need to straighten the wire at all for crimping, thus, avoiding the disadvantages associated with that operation such as misfeeds of the crimping machines. The crimping process can be run at higher speed, and there is less waste and greater production efficiency because the bond between the insulation sheath and the strands is not disrupted, allowing effective stripping of the wire as required for effecting electrical connections.

Because of the higher breaking force and fatigue life, the wires according to the invention can better endure rougher handling during installation in a vehicle and the harsh environment encountered in everyday use. The steel protects the softer, weaker copper strands, takes a greater proportion of the tension forces and stresses due to vibration or relative movement between the different parts of the vehicle to which the wire is attached, while the copper strands provide superior conductivity for carrying electrical current for signals and heating elements as typically found in oxygen sensors.

The oxygen sensor lead wire according to the invention provides a wire with significant advantages over many prior art lead wires in terms of tensile strength, fatigue life and manufacturing speed while also being significantly less expensive and easier to produce than wire designs using more than 19 strands to achieve increased fatigue life.

What is claimed is:

1. A lead wire for use with an oxygen sensor, said lead wire comprising:

an elongate center strand having a relatively high tensile strength;

a plurality of elongate first strands, each having a relatively high electrical conductance, said first strands being arranged circumferentially in spaced relation around said center strand;

a plurality of elongate second strands, each having a relatively high tensile strength, said second strands being arranged circumferentially in spaced relation around said center strand and between said first strands in an alternating pattern;

a plurality of elongate third strands having a relatively high electrical conductance, said third strands being arranged circumferentially in a plurality of groups around said first and second strands, each of said groups having a predetermined number of said third strands; and a plurality of elongate fourth strands having a relatively high tensile strength, said fourth strands being arranged circumferentially around said first and second strands, each of said fourth strands being positioned between two of said groups of said third strands.

2. A lead wire according to claim 1, wherein said first strands are spaced at substantially equal separation angles around said center strand.

3. A lead wire according to claim 1, wherein said fourth strands are spaced at substantially equal separation angles around said center strand.

4. A lead wire according to claim 1, wherein said second and fourth strands are each comprised of a different high tensile strength material.

5. A lead wire according to claim 1, wherein said center strand is comprised of hard stainless steel.

6. A lead wire according to claim 5, wherein said first and third strands are comprised of a copper alloy.

7. A lead wire according to claim 6, wherein said second strands are comprised of hard stain less steel.

8. A lead wire according to claim 7, wherein said fourth strands are comprised of half-hard stainless steel.

9. A lead wire according to claim 7, wherein said fourth strands are comprised of quarter-hard stainless steel.

10. A lead wire according to claim 1, wherein all of said strands have a gage of about #32 AWG.

11. A lead wire according to claim 10, comprising three of said first strands and three of said second strands.

12. A lead wire according to claim 11, comprising nine of said third strands and three of said fourth strands.

13. A lead wire according to claim 12, comprising three of said groups of said third strands, each of said groups comprising three of said third strands.

14. A lead wire according to claim 1, further comprising an elongate tubular sheath of an insulating material circumferentially surrounding said third and fourth strands, said sheath having a plurality of passages extending lengthwise therealong allowing the passage of gases through said sheath to said oxygen sensor.

15. A lead wire according to claim 1, said lead wire having a gage of about #20 AWG.

16. A lead wire for use with an oxygen sensor, said lead wire comprising:

an elongate center strand having a relatively high tensile strength;

three elongate first strands, each having a relatively high electrical conductance, said first strands being arranged circumferentially in spaced relation around said center strand;

three elongate second strands, each having a relatively high tensile strength, said second strands being arranged circumferentially in spaced relation around said center strand and between said first strands in an alternating pattern;

nine elongate third strands having a relatively high electrical conductance, said third strands being arranged circumferentially in three groups of three strands around said first and second strands; and three elongate fourth strands having a relatively high tensile strength, said fourth strands being arranged circumferentially around said first and second strands, each of said fourth strands being positioned between two of said groups of said third strands.

17. A lead wire according to claim 16, wherein said first strands are spaced at substantially equal separation angles around said center strand.

18. A lead wire according to claim 16, wherein said fourth strands are spaced at substantially equal separation angles around said center strand.

19. A lead wire according to claim 16, wherein all of said strands have a gage of about #32 AWG.

20. A lead wire according to claim 16, said lead wire having a gage of about #20 AWG.

21. A lead wire according to claim 16, wherein said center strand is comprised of hard stainless steel.

22. A lead wire according to claim 21, wherein said first and third strands are comprised of a copper alloy.

23. A lead wire according to claim 22, wherein said second strands are comprised of hard stainless steel.

24. A lead wire according to claim 23, wherein said fourth strands are comprised of half-hard stainless steel.

25. A lead wire according to claim 23, wherein said fourth strands are comprised of quarter-hard stainless steel.

* * * * *